US011815102B2

(12) United States Patent
Welte

(10) Patent No.: US 11,815,102 B2
(45) Date of Patent: Nov. 14, 2023

(54) AXIAL SECURING OF A PUMP

(71) Applicant: Schwabische Huttenwerke Automotive GmbH, Aalen (DE)

(72) Inventor: Claus Welte, Aulendorf (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/963,393

(22) Filed: Oct. 11, 2022

(65) Prior Publication Data

US 2023/0113025 A1 Apr. 13, 2023

(30) Foreign Application Priority Data

Oct. 12, 2021 (DE) ..... 10 2021126416.2

(51) Int. Cl.
*F04D 29/40* (2006.01)
*F04D 3/00* (2006.01)

(52) U.S. Cl.
CPC ..... *F04D 29/406* (2013.01); *F04D 3/00* (2013.01)

(58) Field of Classification Search
CPC ..... F04D 29/406; F04D 3/00
USPC ..... 415/214.1
See application file for complete search history.

(56) References Cited

U.S. PATENT DOCUMENTS 4,596,519 A 6/1986 Tuckey
4,662,827 A 5/1987 Wiernicki
5,876,192 A * 3/1999 Follmer ..... F01C 21/10 418/179
8,784,083 B2 * 7/2014 Dippel ..... F01C 21/0863 418/256
10,087,929 B2 10/2018 Welte
11,608,828 B2 * 3/2023 Welte ..... F04C 15/0026
2015/0125332 A1 5/2015 Rosenkranz et al.
(Continued)

FOREIGN PATENT DOCUMENTS

DE 102013209877 A1 12/2014
DE 102015017078 A1 10/2016
(Continued)

OTHER PUBLICATIONS

German Search Report issued in German Patent Application No. 10 2021 126 416.2 dated Jun. 21, 2022, 6 pages, with partial translation.
(Continued)

*Primary Examiner* — J. Todd Newton
(74) *Attorney, Agent, or Firm* — RatnerPrestia

(57) ABSTRACT

A pump includes a pump housing including an inlet for the fluid on a low-pressure side, an outlet for the fluid on a high-pressure side, a circumferential wall facing faces axially away from the delivery chamber and on which the outlet emerges; a spring structure arranged on the outer end face of the end wall; a delivery member movable within the delivery chamber for delivering the fluid from the low-pressure side to the high-pressure side; and a securing device for axial securing the pump housing. The securing device includes a female holding element having an axially extending cavity and a male holding element in a joining engagement, exposable to an axial tensile load, with the female holding element in the cavity. The spring structure and/or the end wall is/are held on the pump housing by one of the holding elements by the joining engagement.

19 Claims, 3 Drawing Sheets

(56) References Cited

U.S. PATENT DOCUMENTS

| | | | | |
|---|---|---|---|---|
| 2016/0305427 | A1* | 10/2016 | Welte | F04C 2/3446 |
| 2017/0211571 | A1* | 7/2017 | Popelka | F04C 18/344 |
| 2018/0372097 | A1* | 12/2018 | Welte | F04C 2/3445 |
| 2021/0025387 | A1* | 1/2021 | Borchers | F04C 2/344 |
| 2021/0404467 | A1* | 12/2021 | Welte | F04C 15/06 |
| 2021/0404470 | A1* | 12/2021 | Welte | F04C 27/009 |
| 2022/0145884 | A1* | 5/2022 | Welte | F04C 15/0023 |
| 2022/0186834 | A1* | 6/2022 | Meinig | F04C 15/0023 |

FOREIGN PATENT DOCUMENTS

| | | | |
|---|---|---|---|
| DE | 102016204098 | A1 | 9/2017 |
| EP | 3081744 | B1 | 4/2016 |
| EP | 3929439 | A1 | 12/2021 |
| EP | 3929441 | A1 | 12/2021 |
| EP | 4012233 | A1 | 6/2022 |
| JP | 2021088993 | A | 6/2021 |
| WO | 2010045906 | A2 | 4/2010 |

OTHER PUBLICATIONS

German Search Report for German Patent Application No. 10 2020 116 731.8 with translation, dated May 10, 2021, 17 pages.
USPTO Non Final Office Action for U.S. Appl. No. 17/340,475, dated May 6, 2022, 13 pages.
Extended European Search Report for European Application No. 22200759.3, dated Mar. 15, 2023 with translation, 15 pages.

* cited by examiner

AXIAL SECURING OF A PUMP

CROSS REFERENCE TO RELATED APPLICATIONS

This application claims benefit of priority to German Patent Application No. 10 2021 126 416.2, filed Oct. 12, 2021. The contents of this application are incorporated herein by reference.

FIELD OF THE INVENTION

The invention relates to a pump, in particular a rotary pump, comprising a spring structure and in particular the arrangement of the spring structure on the pump. The invention also relates to axial securing the pump, in particular the pump housing, for example for transporting the pump and/or while the pump is in operation. The invention relates in particular to the manner in which the spring structure and/or an end wall of the pump housing is held on the housing of the pump, and in particular to a pre-assembled pump unit and/or assembly unit.

The pump can be used as a transmission pump for supplying pressure fluid to a transmission, for example an automatic transmission or steering gearbox of a vehicle or a transmission of a wind turbine. In another application, it can be used as a lubricating oil pump and/or coolant pump for supplying lubricating oil and/or coolant to a combustion engine and/or an electric motor, for example a drive motor of a vehicle. A combined application as a lubricating oil pump and/or coolant pump and additionally as a transmission pump is likewise conceivable, particularly in embodiments in which the pump is a multi-flux pump. It can also conceivably be embodied as a vacuum pump. The pump can be a mono-flux or multi-flux pump, in particular a multi-circuit pump. The pump can advantageously be embodied as a cartridge.

BACKGROUND OF THE INVENTION

Cartridge pumps which can be introduced as an assembly unit into an accommodating device, in particular an accommodating well, of for example a transmission are known from the prior art. Generally, the pump—in particular, the pump housing—is axially secured by a press-fit or by additional elements which are accessible from without, such as for example securing rings. When assembling or disassembling the pump, such axial securing devices generate dirt particles in the form of attrition, which can lead to damage while the pump is in operation or, in the worst case, to a failure of the pump due to wear. Press-fits in particular cannot be disassembled without being destroyed or damaging the surface and/or increasing the tolerance of the pump due to squeezing.

In the known pumps, spring structures for exerting an axial force on the pump housing are in particular sometimes placed loosely into the accommodating well during assembly or are installed within the pump housing, for example between a housing cover and a circumferential wall. If the spring structure is placed loosely into the accommodating well during assembly and lies in the join between an end face of the pump housing and a connecting wall of the accommodating device, the spring structure is held in position primarily by an axial contact pressure.

Assembling the spring structure loosely in this way can mean that the spring structure is not optimally flush with the end wall of the pump housing in an axial view and for example exhibits a radial offset with respect to the pump housing and/or is placed into the accommodating device the wrong way round, i.e. in the case of a circular spring structure, rotated by 180° with the diameter as the rotary axis. This can mean that the pressure force exerted on the pump housing by the spring structure is not introduced uniformly into the pump housing, which can cause malfunctions and leaks, in particular if the spring structure is simultaneously accorded a sealing function between an outlet of the pump and a pressure port of the accommodating device.

SUMMARY OF THE INVENTION

It is therefore an aim of the invention to axially secure the pump housing and/or spring structure, in particular in a way which can be released again.

A pump, such as an aspect of the invention relates to, comprises a pump housing featuring a delivery chamber which is surrounded radially by a circumferential wall. The pump housing comprises an inlet for the fluid on a low-pressure side, at least one outlet for the fluid on a high-pressure side, and a delivery member which can be moved within the delivery chamber for delivering the fluid from the low-pressure side to the high-pressure side. The delivery member is preferably formed by a rotating delivery rotor, for example a rotor of a vane pump comprising at least one vane.

If the pump is arranged in a pump circulation, the low-pressure side of the pump extends from a reservoir, from which the pump suctions the fluid, via the inlet up to at least a delivery chamber inlet. If the transition from low pressure to high pressure occurs in the delivery chamber, the low-pressure side of the pump also comprises the low-pressure side of the delivery chamber, i.e. it extends on the low-pressure side up to and into the delivery chamber.

The high-pressure side of the pump comprises the high-pressure region which extends in the pump housing, in particular including the high-pressure region of the delivery chamber, and also extends up to at least the unit to which the fluid is to be supplied or, if the pump supplies the fluid to multiple units, up to each of these units. If the pump is arranged in a housing of a unit to which pressure fluid is to be supplied, in particular in an accommodating device of the unit housing, the high-pressure side comprises the high-pressure region which extends in the pump housing and the high-pressure region which extends in the accommodating device, up to a pressure port of the accommodating device through which the pressure fluid flowing through the outlet of the pump can be discharged.

The delivery chamber is delimited in the axial direction by an end wall. The at least one outlet for the fluid delivered from the delivery chamber emerges on an outer end side of the end wall which faces away from the delivery chamber. The pump can comprise a gasket which is designed to seal off the outlet on the outer end face of the end wall. The gasket can comprise a gasket loop which surrounds the outlet on the outer end face of the end wall. The gasket, if provided, is preferably embodied as an axial gasket. If the pump is a multi-flux pump, in a particular multi-circuit pump, the axial gasket can in particular serve to fluidically separate the individual outlets.

The pump housing comprises the circumferential wall and the end wall as a first end wall. The pump housing also comprises another, second end wall which is arranged on the axial end side of the circumferential wall which faces away from the first end wall. The first end wall or the second end wall can be embodied in one piece with the circumferential wall, to form a housing cup. The first end wall or the second end wall can be joined to or original-moulded, for example cast, together with the circumferential wall and form a housing cup. The circumferential wall, the first end wall and the second end wall are preferably components which are produced separately from each other and preferably pressed axially against each other in a loose pressure contact. The circumferential wall, the first end wall and the second end wall are preferably held together axially by a securing device.

The pump preferably comprises a spring structure for applying a pressing force to the pump housing. The pressing force serves in particular to press the circumferential wall, the first end wall and/or the second end wall against each other in a seal. The spring structure is preferably arranged on the outer end face of the end wall. The spring structure is preferably arranged in the axial direction on the first end wall of the pump housing, in particular on the outer end side of the first end wall which faces away from the delivery chamber.

The spring structure is preferably formed by a mechanical spring and can in particular be formed by a disc spring. The spring structure is preferably formed by a ring, in particular an annular disc, which can be exposed to a load in the axial direction. The spring structure can be configured in the shape of a conical cup, in particular as an annular disc in the shape of a conical cup. Alternatively, or additionally, the spring structure can be embodied to be undulating in the circumferential direction; the spring structure can in particular be an undulating annular spring.

The spring structure can also be slotted, i.e. the spring structure can exhibit slots which extend in the radial direction, wherein the slots extend radially outwards from the radially inner side and/or radially inwards from the radially outer side. As an alternative to or in addition to the slots, the spring structure can also have other cavities, for example circular segment-shaped or angular cavities on the radially outer side or radially inner side of the spring structure and/or angular or circular holes.

In preferred embodiments, the pump housing forms a pre-assembled pump unit, i.e. an assembly unit, with the spring structure. In such embodiments, the pump comprises a securing device for axial securing the pump housing, in particular for transport. The securing device comprises a female holding element having an axially extending cavity and a male holding element which can be moved into a joining engagement, which can be exposed to an axial tensile load, with the female holding element in the cavity, and preferably an additional holding element. In alternative embodiments, the securing device can also axially secure the pump housing only.

The circumferential wall can advantageously be connected to the first end wall and/or the second end wall via by a holding device, in particular at least one holder. The end wall or walls is/are positioned in terms of their rotational angular position relative to the circumferential wall and held together by the holding device. The holding device can be embodied separately from the securing device. The holding device is preferably formed by the securing device, in particular by at least one of the holding elements.

The holder of the holding device is preferably formed by one of the holding elements, preferably the female holding element. For this purpose, a rod-shaped portion of one of the holding elements, preferably the female holding element, preferably protrudes into or through the first end wall and/or the second end wall. A rod-shaped portion of one of the holding elements, preferably the female holding element, can also protrude into or through the circumferential wall.

The additional holding element is preferably another, optional holding element which is separate from the male holding element and the female holding element. In alternative embodiments, the additional holding element can be embodied in one piece with the male holding element or the female holding element. The securing device serves to axially secure the pump housing, in particular the spring structure and/or the end wall. The securing device preferably serves to axially secure the pump housing, and in particular axially secure the spring structure and/or the end wall on the pump housing, in a way which can be released again. In embodiments with no spring structure and/or no additional holding element in particular, the securing device secures the end wall on the pump housing.

The holding elements serve in particular to hold the individual components of the pump together. The pre-assembled assembly unit preferably comprises at least the circumferential wall, the end wall, optionally the other, second end wall, the delivery member which is arranged in the pump housing, and preferably the spring structure, wherein the securing device axially secures the assembly unit.

An outer end face of the spring structure and/or end wall which faces axially away from the delivery chamber is preferably in axial contact with the securing device, in particular with one of the holding elements, whereby the spring structure and/or end wall is/are held on the pump housing. Whenever the end wall is said to be held on the pump housing, this means that the end wall is in particular held on the circumferential wall and/or the second end wall of the pump housing. In preferred embodiments, the spring structure and/or the end wall is/are held on the pump housing by one of the holding elements by way of the joining engagement. In particular, a rear side of the spring structure which faces axially away from the pump housing is preferably in axial contact with the securing device, in particular with one of the holding elements, whereby the spring structure is held on the pump housing.

A front side of the spring structure which axially faces the pump housing is preferably in axial contact with the first end wall. A rear side of the spring structure which faces axially away from the pump housing is preferably in axial contact with one of the holding elements, whereby the spring structure is held on the pump housing. In particular, one of the holding elements presses the spring structure against the pump housing in the axial direction by way of its axial contact with a rear side of the spring structure which faces axially away from the pump housing.

When the pump is pre-assembled, the spring structure is preferably held directly or indirectly on the pump housing by way of the joining engagement between the male holding element and the female holding element. If the pump comprises an additional holding element, said additional holding element is preferably held directly or indirectly on the pump housing by way of the joining engagement between the male holding element and the female holding element when the pump is pre-assembled. The additional holding element is preferably held directly on the pump housing by way of the joining engagement between the male holding element and the female holding element.

In an axial view onto the spring structure, the spring structure can be overlapped by one of the holding elements, preferably the additional holding element, which can engage behind it as viewed from the end wall. The additional holding element preferably overlaps at least partially with the spring structure in an axial view onto the spring structure and holds the spring structure on the pump housing. In alternative embodiments, the end wall is overlapped in an axial view onto the end wall by one of the holding elements, preferably the additional holding element, which can engage behind it as viewed from the delivery chamber. In embodiments comprising an additional holding element, said additional holding element is preferably held by way of the joining engagement between the holding elements, and the spring structure and/or end wall is/are held on the pump housing by the additional holding element.

In preferred embodiments, an outer circumference of the additional holding element comprises at least one tongue which protrudes radially outwards and overlaps the spring structure in an axial view onto the end wall. The additional holding element preferably comprises at least two, in particular four, tongues which are distributed uniformly on the outer circumference.

In alternative embodiments, in particular in embodiments with no additional holding element, the spring structure can be overlapped in an axial view onto the spring structure by the female holding element or the male holding element, which can engage behind it as viewed from the end wall. In this case, the spring structure is preferably overlapped in an axial view onto the spring structure by the male holding element, which can engage behind it as viewed from the end wall.

Alternatively, the end wall can be overlapped in an axial view onto the end wall by the female holding element or the male holding element, which can engage behind it as viewed from the delivery chamber, even in embodiments with no additional holding element.

Particularly preferably, an end face of the spring structure and end wall which faces axially away from the delivery chamber is in contact with the additional holding element, and the spring structure and end wall are held on the pump housing by way of the joining engagement between the female holding element and the male holding element, wherein the end wall is preferably in axial contact with the additional holding element on the radially inner side of the axial contact between the additional holding element and the spring structure.

In order to establish the joining engagement, one of the male holding element and the female holding element is moved into contact with the other of the male holding element and the female holding element relative to the pump housing and/or relative to the spring structure. If the pump comprises an additional holding element, the male holding element or the female holding element is preferably additionally moved into contact with the additional holding element relative to the pump housing and/or relative to the spring structure when the joining engagement is established. The joining engagement is preferably based on a positive fit and/or friction fit. A material fit is not to be ruled out, although the joining engagement preferably does not involve a material fit.

The pump housing can be assembled or can already be assembled by means of an assembly structure on an accommodating device provided at the assembly location. When the pump is said to be assembled or able to be assembled "on" an accommodating device, this also includes assembling it within the accommodating device. The assembly structure can be a constituent part of the pump. It can be provided in addition to the pump housing or can be formed by one of the components of the pump housing mentioned, for example the first end wall or the second end wall. In alternative embodiments, an assembly structure can be provided as a constituent part of the accommodating device and thus externally in relation to the pump.

The accommodating device can in particular be a housing of a unit to which the pressure fluid is to be supplied, such as for example a transmission or a motor. When it is assembled, the first end wall or the second end wall, but preferably the first end wall, lies axially opposite a connecting wall of the accommodating device. The connecting wall of the accommodating device can in particular be a base of an accommodating well for the pump. A pressure port, via which the pressure fluid flowing through the outlet can be discharged, can emerge on the connecting wall of the accommodating device.

If the pump is arranged, in particular assembled, in or on the accommodating device, such that the outlet of the pump lies axially opposite and faces the connecting wall of the accommodating device, the spring structure is preferably axially tensed. The spring structure is preferably tensed between the connecting wall and the end face of the end wall which faces the connecting wall when the pump is installed.

When the pump is installed, the securing device is not in axial pressure contact, in particular sealing contact, with the connecting wall of the accommodating device. Excluding an axial pressure contact, in particular sealing contact, with the connecting wall is not intended to mean that the securing device is not in any contact with the connecting wall of the accommodating device. The securing device can exhibit axial contact with the connecting wall of the accommodating device, wherein said contact does not however exert any permanent axial pressure forces on the securing device. The securing device can thus be in axial contact with the connecting wall of the accommodating device when the pump is installed, without being pressed against it, as is for example the case with axial gaskets. Particularly preferably, the securing device is not in axial contact with the connecting wall of the accommodating device when the pump is installed.

The securing device and in particular the additional holding element preferably has no sealing function, in particular when the pump is installed. In particular, the securing device preferably does not serve to fluidically separate the high-pressure side and the low-pressure side when the pump is installed. In particular, the securing device does not serve to establish a sealed fluid connection between the outlet of the pump and the pressure port of the accommodating device when installed.

When the pump is installed, the securing device is preferably surrounded on the radially outer side by the spring structure, wherein the securing device can at least partially overlap with the spring structure in an axial view onto the spring structure. The securing device preferably does not extend radially outwards as far as the spring structure.

When the pump is installed, the additional holding element is preferably surrounded on the radially outer side by the spring structure, wherein the additional holding element can at least partially overlap with the spring structure in an axial view onto the spring structure. The additional holding element preferably does not extend radially outwards as far as the spring structure. The spring structure preferably surrounds the female holding element and/or the male holding element in the radial direction, wherein the female holding element and/or the male holding element can at least partially overlap with the spring structure in an axial view onto the spring structure.

When the pump is installed, the spring structure can be in axial contact, in particular an axial pressure contact, with the connecting wall of the accommodating device. When the pump is installed, the spring structure is preferably in an axial sealing contact with the connecting wall of the accommodating device in order to establish a sealed fluid connection between the outlet of the pump and the pressure port of the accommodating device. The spring structure can in particular assume a sealing function and fluidically connect the outlet of the pump to the pressure port of the accommodating device and simultaneously separate it fluidically from the low-pressure side.

If the spring structure assumes a sealing function and/or an additional gasket, in particular a radial gasket, is provided for establishing a sealed fluid connection between the outlet of the pump and the pressure port of the accommodating device, the securing device—in particular the part of the securing device which is visible in an axial view onto the end wall—is arranged completely within the high-pressure side. The fluid which flows around the securing device is thus preferably exclusively pressure fluid from the high-pressure side. In this case in particular, the additional holding element is arranged completely on the high-pressure side. In particular, the fluid which flows around the additional holding element is thus preferably exclusively pressure fluid from the high-pressure side. The female holding element and/or the male holding element is/are preferably also arranged within the high-pressure side of the pump.

The male holding element and the female holding element can be embodied as components which are separate from the additional holding element and/or pump housing. Alternatively, the male holding element and/or the female holding element can be formed by the additional holding element and/or the pump housing, for example an end wall.

One of the male holding element and female holding element can then for example be formed by the additional holding element or the pump housing, while the other of the male holding element and the female holding element is embodied as a separate component. If one of the male holding element and the female holding element is a constituent part of the additional holding element and/or pump housing, the corresponding holding element is preferably formed on a radially outer edge of the additional holding element and/or on the end wall of the pump housing.

The additional holding element is preferably embodied as another, optional holding element which is separate from the male holding element and the female holding element and is held by way of the joining engagement between the female holding element and the male holding element. The additional holding element can be held between the female holding element and the male holding element, wherein the female holding element and/or the male holding element preferably protrude(s) through the additional holding element.

The additional holding element preferably comprises at least one passage through which the female holding element or the male holding element, but preferably the male holding element, can axially protrude. The passage can be formed on a radially outer edge of the additional holding element, in particular in the region of a tongue which protrudes radially outwards on an outer circumference of the additional holding element.

The tongue of the additional holding element, if provided, preferably overlaps the spring structure in an axial view onto the end wall. The additional holding element preferably comprises multiple tongues which protrude outwards in an axial view onto the additional holding element, for example two tongues which are diametrically opposite each other or four tongues which are radially opposite each other in pairs. If the additional holding element comprises multiple tongues, the latter are preferably distributed uniformly along the outer circumference. One tongue preferably exhibits the same angular distance from its directly adjacent tongues or, if there are two tongues, from its adjacent tongue in both circumferential directions, for example 90° if there are four tongues, 120° if there are three tongues or 180° if there are only two tongues.

A passage for the female holding element or the male holding element can then be formed in the region of each tongue or only at individual tongues. The additional holding element preferably comprises multiple tongues, wherein alternately one passage or no passage is formed for the female holding element and/or the male holding element in the region of the tongues.

The additional holding element is preferably formed separately from the female holding element and the male holding element and is preferably held by way of the joining engagement between the female holding element and the male holding element. In alternative embodiments, the additional holding element can be formed together with the male holding element or the female holding element and can form an individual component with the male holding element or the female holding element. In this way, the additional holding element is situated immediately in joining engagement with the male holding element or the female holding element.

The additional holding element preferably overlaps with the end wall in an axial view onto the end wall, in particular the first end wall, and preferably holds the pump housing axially together. The additional holding element preferably overlaps with the outlet in an axial view; in particular, the additional holding element completely covers the outlet in an axial view.

In preferred embodiments, the end wall—in particular, the first end wall—extends further in the radial direction than the additional holding element, such that the end wall protrudes beyond the additional holding element in the radial direction. The additional holding element can be in contact with the end wall on its side which axially faces the pump housing, whereby it can hold the end wall on the pump housing. The additional holding element can preferably be at least partially in axial contact with the end wall and in particular rest on the end wall. In alternative embodiments, the additional holding element is not in direct contact with the first end wall. The additional holding element can axially secure the first end wall, in particular by way of its axial contact with the end wall, in the axial direction relative to the circumferential wall and/or the second end wall.

When the pump is installed, the additional holding element can be exclusively in contact, in particular axial contact, with the female holding element and/or the male holding element, the spring structure and preferably the first end wall. The rear side of the additional holding element which faces away from the end wall is preferably exclusively in contact, in particular axial contact, with the male holding element or the female holding element. The rear side of the additional holding element which faces away from the end wall is preferably exclusively in contact, in particular axial contact, with the male holding element.

The additional holding element is preferably formed by a plate or a flat cup. The additional holding element can be embodied to be planar or cup-shaped, in particular concave or convex in relation to the pump housing. In preferred embodiments, the additional holding element is a planar plate. The additional holding element, in particular its circumference, is preferably circular. The additional holding element can comprise one or more layers. The additional holding element is preferably formed by one layer.

The additional holding element can be formed by a continuous plate or cup or a perforated plate or cup. The additional holding element is preferably formed by a perforated plate comprising at least one aperture for the fluid. The additional holding element can comprise one or more apertures for the fluid. The apertures preferably exhibit a circular cross-section, but can also exhibit angular cross-sections in alternative embodiments. The additional holding element preferably encompasses the function of a throttle and/or cold start plate.

Advantageously, the axial extent of the cavity of the female holding element is greater than the furthest radial extent of the cavity. The cavity preferably extends more than twice as far in the axial direction as in the radial direction. In advantageous embodiments, the cavity of the female holding element extends further in the axial direction than the average thickness of the spring structure, wherein the average thickness of the spring structure is to be understood to mean the arithmetic mean of the possibly differing axial extent of the spring structure over its entire surface.

If the female holding element is a constituent part of the pump housing, for example as a recess in the end wall, or if the female holding element is formed by a holder which protrudes through the end wall, the cavity preferably extends up to an opening which axially faces the spring structure and is closed apart from the opening. It is preferably the case that the cavity of the female holding element comprises an opening at a first axial end and a base at a second axial end. A section through the cavity of the female holding element or a part of the cavity transverse to its axial extent is preferably substantially circular, but can also for example be elliptical or rectangular. The expression "substantially circular" within the meaning of the present application is in particular intended to mean not only circular cross-sections but also cross-sections which comprise a circular core, as are for example found in a spline or thread.

The cavity of the female holding element preferably exhibits a substantially constant cross-section along its axial extension. The expression "substantially constant" is in particular intended to also include cross-sections of a thread which can deviate from each other over their axial length depending on the sectional plane. In alternative embodiments, the cross-section of the cavity can change along its axial extent, for example in shape and/or size. The cavity of the female holding element is particularly preferably formed by a drilled blind hole, in particular a circular drilled blind hole.

The male holding element protrudes through the pump housing or the additional holding element and/or protrudes from the pump housing or the additional holding element. In preferred embodiments, the male holding element protrudes through the additional holding element in the axial direction. Particularly preferably, the male holding element protrudes through the additional holding element in the axial direction counter to the first end wall. The male holding element preferably exhibits its furthest extent in the axial direction, i.e. the male holding element extends further in the axial direction than in the radial direction.

A section through the male holding element or a part of the male holding element transverse to the axial direction of the male holding element preferably exhibits a substantially circular cross-sectional area, but can also for example be elliptical, annular or rectangular. The male holding element particularly preferably exhibits a cross-section which is complementary to the cross-section of the cavity of the female holding element.

The male holding element preferably exhibits a variable cross-section along its axial extent; in particular, the cross-section can change in shape and/or size, in particular incrementally, between a first part of the male holding element and a second part of the male holding element. Alternatively, the male holding element can exhibit a constant cross-section along its axial extent. In preferred embodiments, the male holding element comprises a shaft and a head.

The male holding element can be moved into a joining engagement, which can be exposed to an axial tensile load, with the female holding element via the cavity of the female holding element. In other words, the male holding element at least partially protrudes—in particular, the shaft of the male holding element protrudes—into the cavity of the female holding element and forms a joining engagement, which can be exposed to an axial tensile load, with the female holding element. The joining engagement can be embodied in a positive fit and/or in a force fit. The joining engagement is advantageously configured such that it can be released again. In particularly preferred embodiments, the joining engagement between the female holding element and the male holding element can be released without being destroyed.

The male holding element or the female holding element can be in axial contact with the rear side of the additional holding element which faces axially away from the pump housing and can press the additional holding element against the spring structure. A part of the male holding element and/or female holding element preferably protrudes through a passage of the additional holding element and together with another part forms an axial contact with the rear side of the additional holding element which faces away from the pump housing. Particularly preferably, the shaft of the male holding element protrudes through the additional holding element, and its head presses axially against the additional holding element.

The male holding element preferably closes the cavity of the female holding element or its opening, in the joining engagement. Closing the cavity of the female holding element using the male holding element ensures that the abrasion caused by the relative movement between the female holding element and the male holding element during assembly is pressed into the cavity and enclosed in it.

The male holding element closes the cavity of the female holding element in the joining engagement, preferably by protruding at least partially into the cavity. The male holding element or a part of the male holding element can completely or partially span the cavity of the female holding element in the axial direction, i.e. the male holding element or a part of the male holding element protrudes from the opening of the cavity of the female holding element up to the end of the cavity opposite the opening or protrudes from the opening of the cavity towards the end opposite the opening without reaching it.

In preferred embodiments, the male holding element comprises a shaft and a head, wherein the shaft axially protrudes through a passage of the additional holding element and into the cavity of the female holding element, wherein the head of the male holding element is in axial contact with the rear side of the additional holding element which faces axially away from the pump housing and presses the additional holding element against the spring structure and/or the end wall, such that the spring structure and/or the end wall is held on the pump housing.

The male holding element can for example form the joining engagement with the female holding element by means of a press-fitting connection or pressure connection. If there is a press-fitting connection or pressure connection, the male holding element exhibits an oversize relative to the cavity of the female holding element, i.e. the male holding element is press-fitted or pressed into the cavity of the female holding element.

The female holding element can then be fitted and/or pressed onto the male holding element, or the male holding element is fitted and/or pressed into the female holding element. In order to establish the joining engagement, the female holding element is moved towards the male holding element or the male holding element is moved towards the female holding element.

The male holding element and the female holding element preferably form a screw engagement. For this purpose, the male holding element—in particular, the shaft of the male holding element—comprises an external thread and the cavity of the female holding element comprises a corresponding internal thread. If there is a screw connection, the male holding element and the female holding element preferably comprise a metric thread. The thread is in particular a metric thread smaller than M5.

In preferred embodiments, one of the holding elements—preferably, the female holding element—is moulded or inserted in or on an end wall, preferably the first end wall, or preferably protrudes into or through the end wall in an axial sliding contact.

The female holding element or its cavity can be introduced in the form of a drilled hole, in particular a drilled blind hole, in the holder or in the end wall, in particular the first end wall. In a preferred embodiment, the female holding element protrudes into the end wall, in particular into a passage of the end wall, in an axial sliding contact and terminates with it, preferably flush with it, on the rear side which faces away from the pump housing.

The male holding element can for example be a screw, a blind rivet, a threaded pin or a press-fit bolt or press-fit pin. The male holding element is preferably a standard part. The male holding element can for example be formed by a threaded pin comprising an external thread, preferably according to DIN EN ISO 4026, DIN EN ISO 4027, DIN EN ISO 4028 or DIN EN ISO 4029 in their versions as current on the filing date of the present application.

The female holding element can in turn be formed for example by a drilled hole, in particular a drilled blind hole, a nut, in particular a cap nut, or a pin comprising an internal thread. The female holding element is preferably a standard part. Preferably, the male holding element and the female holding element are formed by standard parts. The female holding element can for example be formed by a nut, in particular a cap nut, or by a standard pin comprising an internal thread, preferably according to DIN EN ISO 8735 or DIN EN ISO 8733.

The female holding element is preferably a constituent part of the pump housing and positions the circumferential wall and the end wall, in particular as a holder, relative to each other in relation to their angular position, wherein the cavity of the female holding element is provided on an end side of the female holding element which faces the spring structure.

In particularly preferred embodiments, one of the male holding element and the female holding element, preferably the female holding element, axially protrudes from or through the circumferential wall into or through the first end wall. One of the male holding element and the female holding element, preferably the female holding element, preferably protrudes from the second end wall and through the circumferential wall and the first end wall, wherein the holding element can be formed together with the second end wall or fixedly connected to the second end wall as a separate component. The female holding element is preferably formed by a standard pin comprising an internal thread, preferably according to DIN EN ISO 8735 or DIN EN ISO 8733.

The pump can for example be a linear displacement pump or more preferably a rotary pump. As a rotary pump, it can be an external-axle pump, for example an external gear pump, or an internal-axle pump, for example a vane pump, an internal gear pump or a pendulum-slider pump. The delivery member can comprise a rotor which can be rotated about a rotational axis in the delivery chamber and which serves to deliver the fluid from one or more inlets to one or more outlets. The rotor can advantageously serve to form delivery cells which periodically increase and decrease in size as the rotor rotates in order to deliver the fluid from the low-pressure side of the pump to the high-pressure side of the pump.

If, as is preferred, the pump is arranged in a vehicle, the pump can be driven by the drive motor of the vehicle, for example a combustion engine or an electric motor. In hybrid vehicles, the pump can be driven either by the combustion engine or by the electric motor. In an advantageous modification, the pump can also be configured such that it can selectively be driven by the combustion engine or by the electric motor or by both of these together. The combustion engine and the electric motor can then in particular drive the pump via an addition transmission.

BRIEF DESCRIPTION OF THE DRAWINGS

The invention is explained below on the basis of example embodiments. Features disclosed by the example embodiments advantageously develop the subject-matter of the claims and also the embodiments explained above. There is shown:

DETAILED DESCRIPTION OF THE INVENTION

Figure 1:
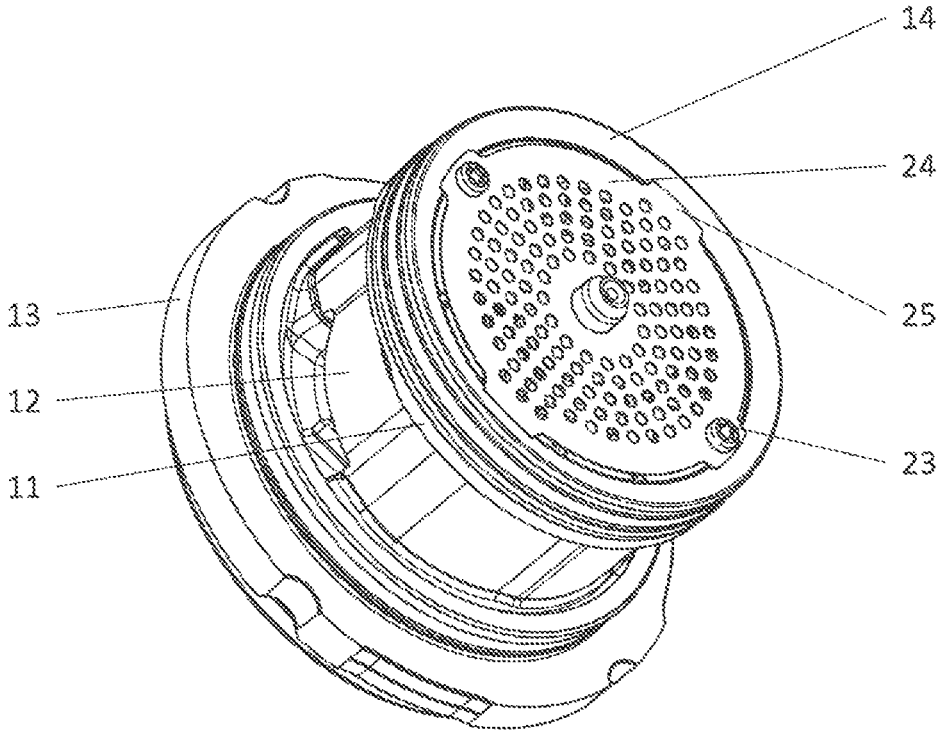
FIG. 1 an isometric view of a pump of a first example embodiment.
Figure 3:
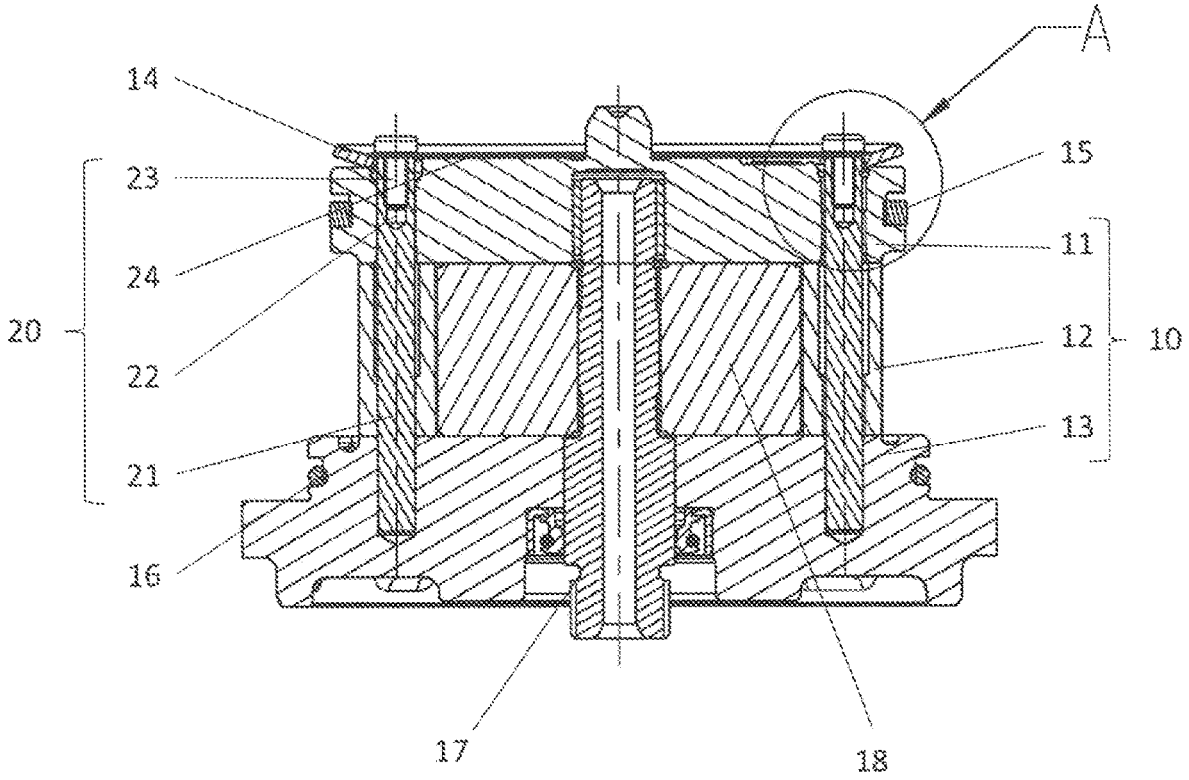
FIG. 3 the pump of the first example embodiment in a longitudinal section.

FIG. 1 discloses a pump of a first example embodiment, in an isometric view. FIG. 3 discloses a longitudinal section of the pump in accordance with the first example embodiment. The pump comprises a pump housing 10 featuring a circumferential wall 12, a first end wall 11 and a second end wall 13. An assembly structure is formed on the second end wall 13, using which the pump can be fixed to an accommodating device, for example by means of screws. The first end wall 11 is formed on the side of the circumferential wall 12 which faces away from the assembly structure. The circumferential wall 12, the first end wall 11 and the second end wall 13 are formed as separate components. In alternative embodiments, the circumferential wall 12 can for example be embodied in one piece with the second end wall 13 or the first end wall 11.

The circumferential wall 12 surrounds a delivery chamber in the radial direction, in which a delivery member 17, 18 for delivering the fluid from a low-pressure side of the pump to a high-pressure side of the pump is situated. The delivery chamber is delineated in the axial direction by the first end wall 11 and the second end wall 13.

The delivery member 17, 18 is preferably formed by a rotating delivery rotor 18 which is non-rotatably connected to a drive shaft 17 which drives it. FIG. 3 is a longitudinal section through the pump. The drive shaft 17 protrudes through the second end wall 13 in the axial direction. The rotor 18 is non-rotatably connected to the drive shaft 17, such that rotating the drive shaft 17 about the rotational axis R rotates the rotor 18 about the rotational axis R.

The delivery rotor 18 is preferably formed by a rotor of a vane pump comprising at least one vane. It should be noted that an aspect of the invention is not restricted to vane pumps. An aspect of the invention can for example also be used in pendulum-slider pumps, external gear pumps or internal gear pumps.

The circumferential wall 12 forms a closed ring, while the end walls 11 and 13 are each embodied to be plate-shaped. An outlet for the fluid emerges on the end wall 11 on the outer end face which faces axially away from the delivery chamber. The pump in accordance with the first example embodiment is embodied as a mono-flux pump, i.e. it comprises one working flux comprising an inlet and an outlet. It should be noted at this juncture that an aspect of the invention is not limited to mono-flux pumps and can also for example be used in multi-flux or multi-circuit pumps, in particular dual-flux pumps, comprising multiple outlets and/or inlets.

The pump housing 10 is secured in the axial direction by a securing device 20. The securing device 20 in accordance with the first example embodiment comprises: a female holding element 21 featuring an axially extending cavity 22; a male holding element 23 which is in a joining engagement, which can be exposed to an axial tensile load, with the female holding element 21 in the cavity 22; and an additional holding element 24.

The spring structure 14 is arranged axially between the first end wall 11 and the additional holding element 24. The additional holding element 24 overlaps the spring structure 14 in a radially inner region of the spring structure 14 in an axial view onto the first end wall 11; preferably, the tongues 25 of the additional holding element 24 overlap the spring structure 14. The additional holding element 24 engages behind the spring structure 14 in an axial view from the first end wall 11 towards the spring structure 14; preferably, the tongues 25 of the additional holding element 24 engage behind the spring structure 14. In this way, the spring structure 14 is held on the pump housing 10 by means of the additional holding element 24. The spring structure 14 which is formed as a mechanical spring, and in the example embodiment as a disc spring, serves to press the housing walls 11, 12 and 13 of the pump housing 1 axially together when the pump is assembled and so seal off the delivery chamber.

The securing device 20 serves in particular to axially secure the spring structure 14 on the pump housing 10 and to axially secure the pump housing 10. In particular, the female holding element 21, the male holding element 23 and the additional holding element 24 serve to secure the spring structure 14 on the pump housing 10 and to axially secure the pump housing 10. In alternative embodiments, in particular embodiments with no spring structure, the securing device can axially secure the end wall 11, instead of the spring structure 14, on the pump housing.

The additional holding element 24 is a holding element which is separate from the male holding element 23 and the female holding element 21. In alternative embodiments, the additional holding element 24 can also be embodied in one piece with the female holding element 21 or with the male holding element 23 and in particular formed by the female holding element 21 or the male holding element 23, as disclosed in FIGS. 6 and 7.

As can be seen in particular from FIG. 3, the additional holding element 24 is held on the pump housing 10 by way of the joining engagement between the male holding element 23 and the female holding element 21. The additional holding element 24 is formed on the side of the first end wall 11 of the pump housing 10. The additional holding element 24 is in particular formed on the side of the pump housing 10 which faces axially away from the second end wall 13.

The outer circumference of the additional holding element 24 comprises at least one tongue 25 which protrudes radially outwards. In particular, the additional holding element 24 comprises four tongues 25 which protrude radially outwards from the additional holding element 24. In accordance with the first example embodiment, the tongues 25 are distributed uniformly over the outer circumference of the additional holding element 24.

The tongues 25 overlap the spring structure 14 in an axial view onto the end wall 11. The spring structure 14 is in axial contact with the additional holding element 24, in particular with the tongues 25 of the additional holding element 24, on a rear side which faces axially away from the pump housing 10, whereby it is held on the pump housing 10. The additional holding element 24 presses the spring structure 14 against the pump housing 10, in particular against the first end wall 11, in the axial direction. The additional holding element 24 also presses the end wall 11 against the pump housing 10, in particular against the circumferential wall 12.

The additional holding element 24 comprises at least one passage through which the female holding element 21 or the male holding element 23 axially protrudes. In accordance with the first example embodiment, the male holding element 23 protrudes through the passage of the additional holding element 24 in the axial direction. In accordance with the first example embodiment, the additional holding element 24 comprises a total of two passages for a male holding element 23 each. The passages are each formed in the region of a tongue 25 on the outer edge of the additional holding element 24. In accordance with the first example embodiment, a male holding element 23 respectively protrudes through the additional holding element 24 in the axial direction, counter to the first end wall 11.

The additional holding element 24 is in axial contact with a part of the male holding element 23 on a rear side which faces axially away from the pump housing 10 and is pressed against the spring structure 14 in the axial direction. The additional holding element 24 in turn presses the spring structure 14 against the pump housing 10, in particular against the first end wall 11, in the axial direction, thus holding the end wall 11 on the pump housing 10. As can be seen in particular from FIG. 3, the additional holding element 24 is in axial contact with the spring structure 14 and the first end wall 11 on its front side which axially faces the pump. In this way, the additional holding element 24 presses the spring structure 14 against the first end wall 11 in the axial direction and presses the first end wall 11 towards the second end wall 13 in the axial direction. In this way, the pump housing 10 is held together in the axial direction.

The male holding element 23 protrudes at least partially into the cavity 22 of the female holding element 21 and forms a joining engagement, which can be exposed to an axial tensile load, with the female holding element 21. The joining engagement between the male holding element 23 and the female holding element 21 is embodied such that it can be released again and is formed in accordance with the first example embodiment in the form of a screw connection.

The male holding element 23 closes the cavity 22 of the female holding element 21. Because the male holding element 23 closes the cavity 22 of the female holding element 21, the abrasion caused by the relative movement between the female holding element 21 and the male holding element 23 during assembly is pressed into the cavity 22 and enclosed in it.

The additional holding element 24 is embodied in the form of a perforated plate which overlaps, in particular completely, with the outlet of the pump housing 10 in the axial direction. In this way, the additional holding element 24 additionally assumes a throttling function.

The female holding element 21 is formed on the front side of the additional holding element 24 which faces the pump housing 10. The female holding element 21 is embodied in the form of a holder and is a constituent part of the pump housing 10 and positions the circumferential wall 12 and the end wall 11 relative to each other in terms of their angular position, wherein the cavity of the female holding element 21 is provided on the end side of the female holding element 21 which faces the spring structure 14.

In accordance with the first example embodiment, the female holding element 21 protrudes from the circumferential wall 12 and through the first end wall 11. In particular, the female holding element 21 protrudes from the second end wall 13 in the axial direction through the circumferential wall 12 and through the first end wall 11. In this way, the female holding element 21 positions the first end wall 11 and the second end wall 13 in terms of their rotational angular position relative to the circumferential wall 12 and holds them together.

In accordance with the first example embodiment, the female holding element 21 is embodied in the form of a standard part, in particular a standard pin comprising an internal thread. The male holding element 23 is correspondingly formed by a standardised screw which is in joining engagement with the internal thread of the female holding element 21.

Figure 4:
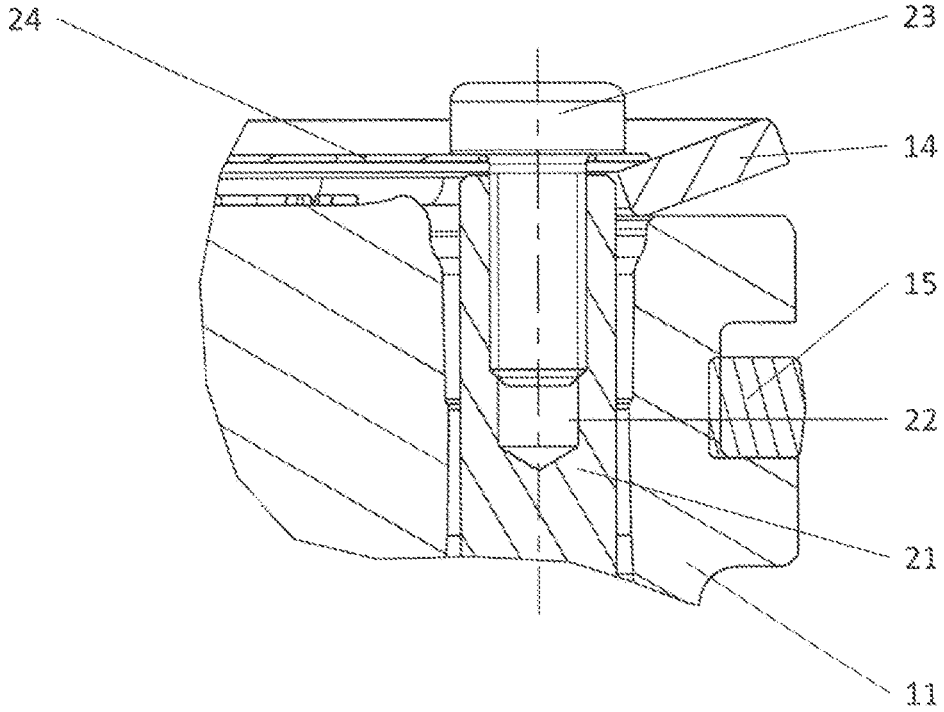
FIG. 4 a detailed view of the joining engagement of the first example embodiment.

FIG. 4 shows the screw engagement between the male holding element 23 and the female holding element 21 in detail, wherein the shaft of the male holding element 23 protrudes axially through a passage of the additional holding element 24 and protrudes into the cavity 22 of the female holding element 21. The passage of the additional holding element 24 is provided on a radially outer edge of the additional holding element 24 and can in particular be formed in the region of the tongues 25.

The head of the male holding element 23 presses axially against the additional holding element 24 such that the additional holding element 24 is in axial contact with the male holding element 23 on a rear side which faces axially away from the pump housing 10. The male holding element 23 axially tenses the additional holding element 24 against the pump housing 10. In alternative embodiments, the additional holding element 24 can be omitted, such that the head of the male holding element 23 presses axially against the end wall 11, such that the end wall 11 is held on the pump housing 10.

The joining engagement is embodied radially within the spring structure 14 in an axial view onto the spring structure 14. The joining engagement is in particular embodied within the sealing contact with the first end wall 11 on the one hand and the connecting wall of the accommodating device, which lies axially opposite when the pump is installed and is not shown in FIGS. 1, 3 and 4, on the other hand in an axial view onto the spring structure 14, wherein the joining engagement is provided in the region of the tongues 25 which protrude radially outwards.

Figure 5:
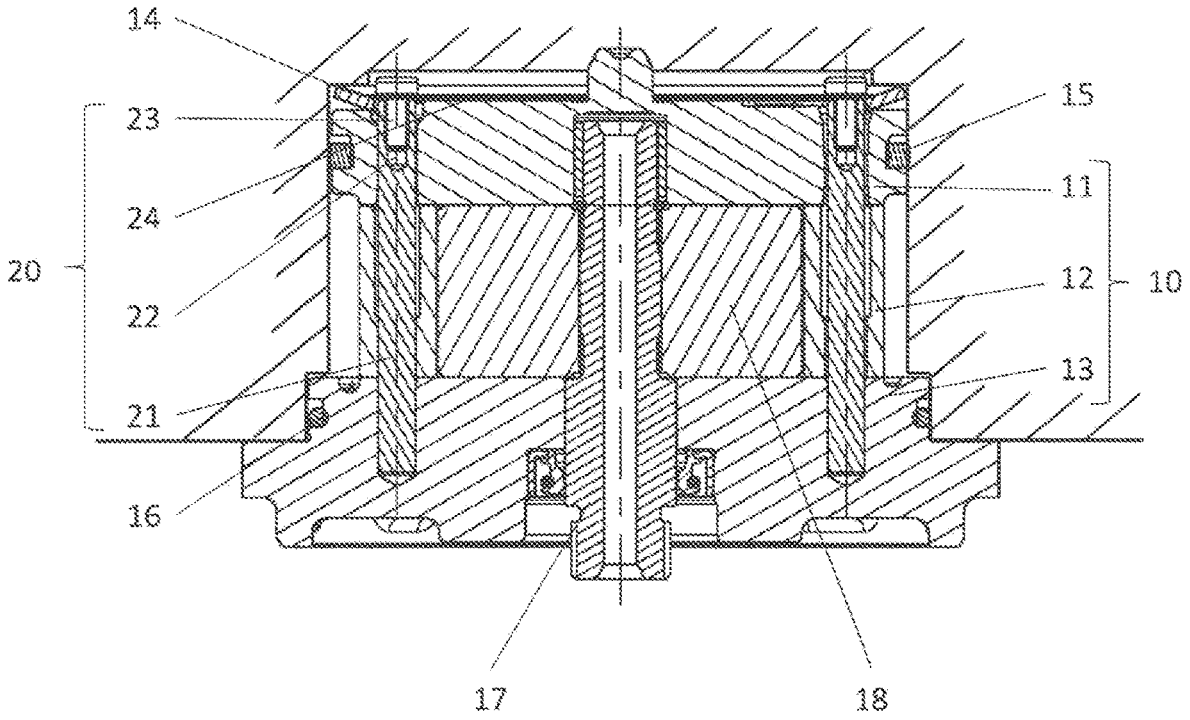
FIG. 5 a longitudinal section of the pump of the first embodiment, when installed.

FIG. 5 shows the pump of the first example embodiment, when installed. The pump is arranged on or in an accommodating device, wherein the first end wall 11 lies axially opposite a connecting wall of the accommodating device. A pressure port, which is not otherwise shown and via which the fluid flowing through the outlet can be discharged, emerges on the connecting wall of the accommodating device. The outlet of the pump axially faces the connecting wall of the accommodating device. The accommodating device is sealed off by a radial gasket 16 arranged on the pump housing 10.

The spring structure 14 is tensed between the connecting wall and the end face of the first end wall 11 which faces the connecting wall. In this way, the spring structure 14 is in axial contact with the first end wall 11 and with the connecting wall of the accommodating device. In particular, the spring structure 14 is in an axial sealing contact with the first end wall 11 and with the connecting wall, such that it additionally functions as an axial gasket which separates the high-pressure side from the low-pressure side. In addition to the spring structure 14, the pump comprises at least one other radial gasket 15 for separating the high-pressure side from the low-pressure side, preferably in the region of the outer circumference of the first end wall 11.

By contrast, the securing device 20 is not in axial contact with the connecting wall of the accommodating device. In accordance with an aspect of the invention, the securing device 20 is not in axial sealing contact, in particular pressure contact, with the connecting wall of the accommodating device. In particular, neither the male holding element 23 nor the additional holding element 24 and the female holding element 21 are in axial contact with the connecting wall of the accommodating device.

As can be seen from FIG. 5, the securing device 20 is embodied exclusively on the high-pressure side of the pump, i.e. only fluid discharged from the pump through the outlet flows around the securing device 20, in particular the additional holding element 24 and the male holding element 23, wherein the spring structure 14 surrounds the securing device 20 on the radially outer side, wherein the additional holding element 24 at least partially overlaps axially with the spring structure 14.

Figure 2:
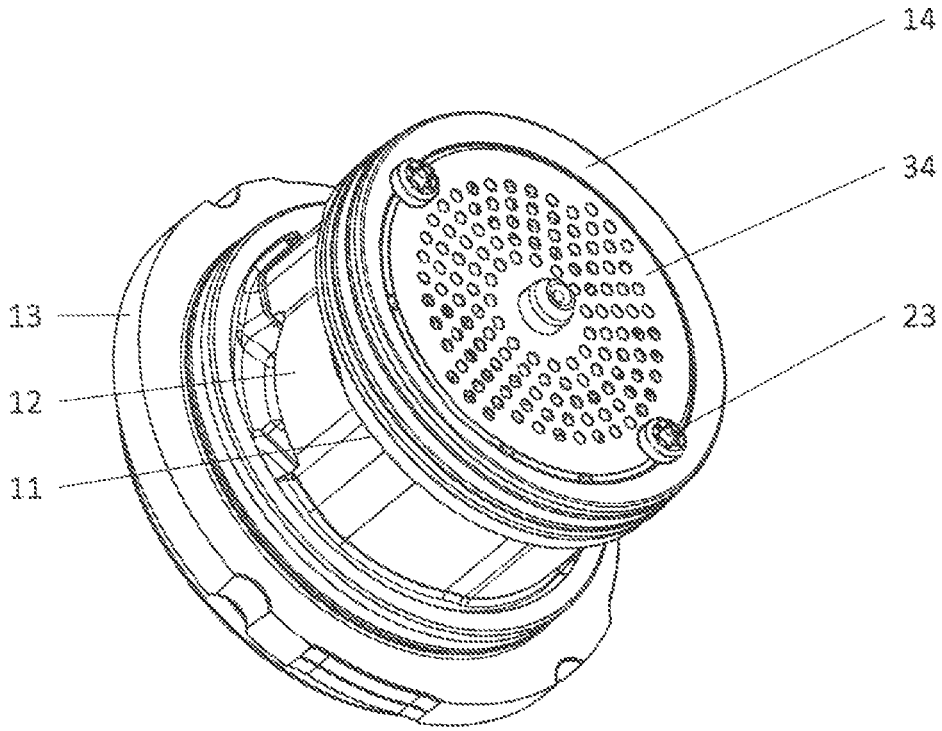
FIG. 2 an isometric view of a pump of a second example embodiment.

FIG. 2 shows an isometric view of a pump in accordance with a second example embodiment. Unless otherwise stated, the statements made with respect to the first example embodiment remain valid, providing they do not contradict the example embodiment in accordance with FIG. 2.

The pump of FIG. 2 differs from the pump of the first example embodiment in that the outer circumference of the additional holding element 34 does not comprise any tongues which protrude radially outwards, and in that the additional holding element 34 does not overlap with the spring structure 14 in an axial view onto the spring structure 14.

In accordance with the second example embodiment, the spring structure 14 is held on the pump housing 10 by the male holding element 23. The male holding element 23 is in axial contact with the additional holding element 34 on the rear side of the additional holding element 34 which faces axially away from the pump housing 10. In particular, the male holding element 23 presses the additional holding element 34 against the pump housing 10 in the axial direction.

Unlike the additional holding element 24 in accordance with the first example embodiment, the additional holding element 34 substantially has a throttling function only and does not secure the spring structure 14 in the axial direction. The additional holding element 34 can however additionally press the first end wall 11 towards the second end wall 13 in the axial direction and so help to secure the pump housing 10 in the axial direction.

The male holding element 23 is also in axial contact with the spring structure 14 on the rear side of the spring structure 14 which faces axially away from the pump housing 10. The male holding element 23 presses the spring structure 14 against the pump housing 10 in the axial direction. In alternative embodiments, the additional holding element 34 in accordance with the second example embodiment can also be omitted. In this case, the pump housing 10 is secured in the axial direction by the male holding element 23, the female holding element 21 and the spring structure 14. In alternative embodiments, the additional holding element 34 can in particular be omitted, such that the head of the male holding element 23 presses axially against the end wall 11 and/or the spring structure 14, such that the end wall 11 and/or the spring structure 14 are held on the pump housing 10.

Figure 6:
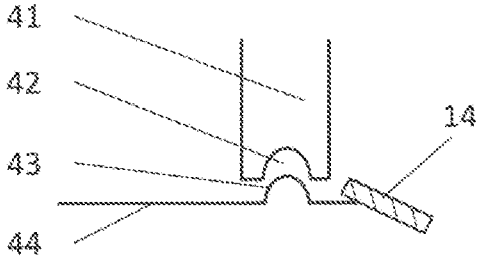
FIG. 6 a schematic view of a joining engagement of a third example embodiment.
Figure 7:
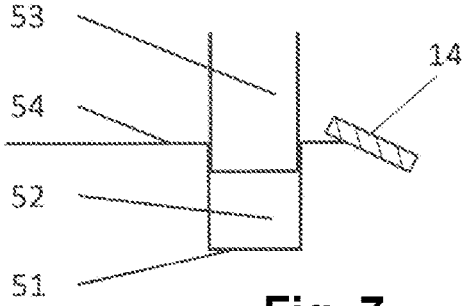
FIG. 7 a schematic view of a joining engagement of a fourth example embodiment.
Figure 8:
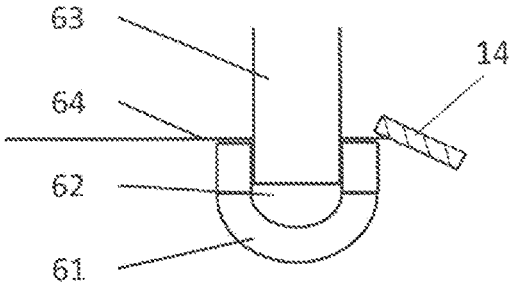
FIG. 8 a schematic view of a joining engagement of a fifth example embodiment.

FIGS. 6 to 8 schematically show other example embodiments of the joining engagement between a female holding element and a male holding element in each case. Features of the first example embodiment, in particular those relating to the spring structure 14 and the pump, also apply to the following example embodiments unless expressly stated otherwise. Wherever differences are not explained or disclosed on the basis of the figures, the statements made above with respect to the first and/or second example embodiment also similarly apply to the other example embodiments.

FIG. 6 shows a third example embodiment in which the male holding element 43 is formed by the additional holding element 44 and does not protrude through it, wherein the additional holding element 44, in particular the tongues 25, exhibit(s) a convex curvature or outward bulge which protrudes from the additional holding element 44 towards the first end wall 11 or female holding element 41. Instead of a curvature or outward bulge, the male holding element 43 of the additional holding element 44 can also be formed as a protruding pin, cam or the like.

The female holding element 41 in turn comprises a concave cavity 42 in relation to the first end wall 11, into which the male holding element 43 can protrude in order to establish a joining engagement, wherein the cavity 42 can be embodied directly on the first end wall 11 or on a separate component, for example a holder as shown in FIG. 3 and FIG. 5.

The cavity 42 of the female holding element 41 is embodied to be complementary to the outward bulge of the male holding element 43. The joining engagement between the male holding element 43 and the female holding element 41 is embodied as a fitting connection. The male holding element 43 has an oversize relative to the cavity 42 of the female holding element 41, such that the male holding element 43 can be pressed into the female holding element 41 and is held in the joining engagement, wherein the holding force with which the male holding element 43 is held in the joining engagement with the female holding element 41 is determined by the oversize of the male holding element 43.

FIG. 7 shows a joining engagement in a fourth example embodiment in which the female holding element 51 is formed by the additional holding element 54, wherein the additional holding element 54, for example the respective tongue 25, forms the female holding element 51 by comprising an outward bulge having a cavity 52 which extends in a direction away from the first end wall 11. The female holding element 51, i.e. the outward bulge, is open towards the end wall 11. The male holding element 53 protrudes from the first end wall 11 and, in the joining engagement, into the female holding element 51. This joining engagement is likewise a fitting connection. The male holding element 53 can be formed by the end wall 11 itself or by a separate component, for example a holder for the pump housing 10. The male holding element 53 can then be an axial projection on the end wall 11, i.e. formed directly on the end wall 11.

In order to form the joining engagement between the male holding element 53 and the female holding element 51, the female holding element 51 is fitted onto the male holding element 53. The male holding element 53 has an oversize relative to the cavity 52 of the female holding element 51, such that the male holding element 53 can be pressed into the female holding element 51 and is held in the joining engagement, wherein the holding force with which the male holding element 53 is held in the joining engagement with the female holding element 51 is determined by the oversize of the male holding element 53.

A fitting engagement is also understood to mean a snapping or latching engagement between the holding elements in the manner of a press-stud connection. It is in principle advantageous if the respective fitting engagement is configured such that the cavity 42 or 52 is closed by the male holding element 43 or 53 to such an extent that any dirt particles that can have entered the cavity 42 or 52 are enclosed and cannot be discharged while the pump is in operation.

FIG. 8 shows a fifth example embodiment of a joining engagement in which the male holding element 63 protrudes through a passage of the additional holding element 64 in a direction away from the first end wall 11. The male holding element 63 protrudes from the first end wall 11 and forms a joining engagement with the female holding element 61. The male holding element 63 can be formed by the end wall 11 itself or by a separate component. The male holding element 63 can then be an axial projection on the end wall 11, i.e. formed directly on the end wall 11.

The end of the male holding element 63 which faces axially away from the second end wall 13 comprises an external thread, in particular a metric external thread, wherein the male holding element 63 can comprise a thread in one axial end portion only or in both axial end portions or can be embodied as a threaded pin which comprises a thread over its entire axial length. In embodiments in which it is a threaded pin with a continuous thread over its axial length or in which it comprises a thread at its axial ends, the male holding element 63 is preferably in a screw engagement with both the female holding element 61 and the second end wall 13.

The female holding element 61 is form as a nut, in particular a cap nut. The female holding element 61 presses axially against the additional holding element 64 in the joining engagement with the male holding element 63, such that the additional holding element 64 is in axial contact with the female holding element 61 on a rear side which faces axially away from the pump housing 10, and thus holds the additional holding element 64 on the pump housing 10.

In modifications of the fifth example embodiment, the male holding element and the female holding element which is provided separately from the additional holding element can also be fitting elements for establishing a fitting engagement instead of a screwing engagement.

In other modifications, holding elements in the form of screw elements, such as for example threaded pins and/or nuts, can be fixedly joined to the additional holding element and preferably arranged on the tongues 25. In such embodiments, the respective complementary screw element is axially fixed on the pump housing 10, but rotatably connected to the pump housing 10 in order to be able to establish the joining engagement as a screwing engagement.

LIST OF REFERENCE SIGNS

10 pump housing
11 first end wall
12 circumferential wall
13 second end wall
14 spring structure
15 radial gasket
16 radial gasket
17 drive shaft
18 rotor
20 securing device
21 female holding element
22 cavity
23 male holding element
24 additional holding element
25 tongue
34 additional holding element
41 female holding element
42 cavity
43 male holding element
44 additional holding element
51 female holding element
52 cavity
53 male holding element
54 additional holding element
61 female holding element
62 cavity
63 male holding element
64 additional holding element

The invention claimed is:

1. A pump for supplying fluid to a unit, the pump comprising:

a pump housing comprising:
- an inlet for the fluid on a low-pressure side,
- an outlet for the fluid on a high-pressure side,
- a circumferential wall which radially surrounds a delivery chamber, and
- an end wall having an outer end face which faces axially away from the delivery chamber and on which the outlet emerges;

a spring structure which is arranged on the outer end face of the end wall;

a delivery member which can be moved within the delivery chamber for delivering the fluid from the low-pressure side to the high-pressure side; and a securing device for axial securing the pump housing, the securing device comprising:
- a female holding element having an axially extending cavity, and
- a male holding element which is in a joining engagement, which can be exposed to an axial tensile load, with the female holding element in the cavity;

wherein the spring structure and/or the end wall is/are held on the pump housing by one of the holding elements by way of the joining engagement; and the securing device is not in an axial sealing contact with a connecting wall of an accommodating device when the pump is installed;

wherein the securing device further comprises an additional holding element and the additional holding element overlaps with the end wall in an axial view and holds the pump housing axially together.

2. The pump according to claim 1, wherein an outer end face of the spring structure and/or end wall which faces axially away from the delivery chamber is in axial contact with one of the holding elements, whereby the spring structure and/or end wall is/are held on the pump housing.

3. The pump according to claim 1, wherein the additional holding element is formed separately from the female holding element and the male holding element and is held by way of the joining engagement between the holding elements.

4. The pump according to claim 1, wherein the additional holding element is formed by a plate or a flat cup which is concave or convex in relation to the pump housing.

5. The pump according to claim 1, wherein the additional holding element additionally encompasses the function of a throttle and/or cold start plate.

6. The pump according to claim 1, wherein the additional holding element overlaps with the spring structure in an axial view onto the spring structure and holds the spring structure on the pump housing.

7. The pump according to claim 1, wherein the additional holding element comprises at least one radially protruding tongue which overlaps with the spring structure in an axial view onto the spring structure and holds the spring structure on the pump housing.

8. The pump according to claim 1, wherein the female holding element or the male holding element is in axial contact with a rear side of the additional holding element which faces axially away from the pump housing and presses the additional holding element against the spring structure and/or against the end wall.

9. The pump according to claim 1, wherein, when the pump is installed, the additional holding element is exclusively in contact with the female holding element and/or the male holding element and/or the spring structure and/or the end wall.

10. The pump according to claim 1, wherein the spring structure is in a sealing contact with the end wall and/or the connecting wall of the accommodating device when the pump is installed.

11. The pump according to claim 1, wherein the female holding element or the male holding element protrudes axially from or through the circumferential wall into or through the end wall.

12. The pump according to claim 1, wherein the female holding element and/or the male holding element is/are arranged on the high-pressure side of the pump.

13. The pump according to claim 1, wherein the spring structure surrounds the female holding element and/or the male holding element in the radial direction.

14. The pump according to claim 1, wherein the female holding element and the male holding element are in joining engagement via a screwing connection.

15. The pump according to claim 1, wherein the female holding element and the male holding element are formed by standard parts comprising metric threads.

16. The pump according to claim 1, wherein the securing device furthermore comprises an additional holding element.

17. The pump according to claim 3, wherein the female holding element and/or the male holding element protrude(s) through the additional holding element.

18. The pump according to claim 4, wherein the additional holding element is perforated and/or comprises one layer and/or is circular.

19. The pump according to claim 15, wherein the female holding element is a standard pin comprising an internal thread and the male holding element is a matching machine screw.

* * * * *